United States Patent [19]

Kersnar et al.

[11] 4,122,043

[45] Oct. 24, 1978

[54] AMIDOBETAINE CONTAINING DETERGENT COMPOSITION NON-TOXIC TO AQUATIC LIFE

[75] Inventors: Paul Kersnar, San Mateo; Robert Joseph O'Connor, Palo Alto, both of Calif.

[73] Assignee: Polytrol Chemical Corporation, Oakland, Calif.

[21] Appl. No.: 619,049

[22] Filed: Oct. 2, 1975

Related U.S. Application Data

[63] Continuation-in-part of Ser. No. 426,182, Dec. 19, 1973, abandoned.

[51] Int. Cl.[2] ..... C11D 1/90; C11D 3/06; C11D 3/10; C11D 3/33

[52] U.S. Cl. ..... 252/527; 252/156; 252/546

[58] Field of Search ..... 252/527, 546, 156

[56] References Cited

U.S. PATENT DOCUMENTS

| | | | |
|---|---|---|---|
| B 388,298 | 1/1975 | Gauterin | 252/527 |
| 3,328,307 | 6/1967 | Schmitz | 252/106 |
| 3,368,978 | 2/1968 | Irani | 252/527 |
| 3,694,366 | 9/1972 | Harris | 252/106 |
| 3,755,559 | 8/1973 | Hewitt | 252/546 X |
| 3,840,480 | 10/1974 | Barrat | 252/545 |
| 3,849,348 | 11/1974 | Hewitt | 252/547 |
| 3,888,798 | 6/1975 | Hansen | 252/545 |
| 3,928,251 | 12/1975 | Bolich | 252/545 |

OTHER PUBLICATIONS

Handbook of Chemistry & Physics, 43rd Ed., Published by The Chemical Rubber Publishing Co., Cleveland Ohio, 1961, p. 1487.

McCutcheon's Detergents & Emulsifiers-1969 Annual, Published by J. W. McCutcheon, Inc., Morristown, N.J., 1969, p. 222.

McCutcheon's Detergents & Emulsifiers, 1970 Annual, Allured Publishing Co., Ridgewood, New Jersey, p. 226.

*Primary Examiner*—Dennis L. Albrecht

*Attorney, Agent, or Firm*—Owen, Wickersham & Erickson

[57] ABSTRACT

An amphoteric surfactant system which, in use, is nontoxic to marine or aquatic life, and which contains as amphoteric surfactant at least one amido betaine of a specified class. Multipurpose detergent systems based upon such betaine and incorporating detergent builders and other adjuncts, all selected to be similarly nontoxic. Advantageously, the detergency builder is sodium hydroxide or a suitable sodium salt such as the carbonate, sesquicarbonate, tripolyphosphate, or other. Also advantageously there is incorporated a chelating agent which is advantageously a sodium salt or compound such as the sodium salt of EDTA; and other adjuncts, such as a soil-suspending agent or optical brightener, are also useful additives. A particular advantage of the composition according to this invention is that it provides washing effluents which are substantially nontoxic to marine or aquatic life, other than microorganisms. Also, there is provided a method for producing such nontoxic washing or detersive aqueous effluent or waste liquid that comprises washing a soiled material with water and a detergent composition comprising an amido betaine as described above and a detergent builder, advantageously comprising also a chelating agent and, if desired, an optical brightener or the like, and separating off the aqueous effluent.

37 Claims, No Drawings

AMIDOBETAINE CONTAINING DETERGENT COMPOSITION NON-TOXIC TO AQUATIC LIFE

REFERENCE TO RELATED APPLICATION

This application is a continuation-in-part of application Ser. No. 426,182, filed Dec. 19, 1973, now abandoned.

BACKGROUND OF THE INVENTION

This invention relates to improvements in heavy-duty detergent compositions and to the problems which such heavy-duty detergents cause when they are sent into rivers, lakes and seas having living fishes and similar aquatic and marine life.

The prior art relative to detergent compositions for various uses probably finds its origin in prehistoric eras and, to say the least, is extensive. The use of true soaps and, in contrast, synthetic surfactants, such as anionic, nonionic, cationic and mixed types, alone, and with builders, is well documented, with indicated efficacies for a multitude of applications. The prior art also teaches the use of various amphoteric type surfactants in detergent applications (See, for example, U.S. Pat. Nos. 3,719,613, 3,452,065, 3,654,166, 3,280,179). The widespread use of amphoteric surfactants was probably precluded for economic reasons. The largest commercial and household usage of surfactants is comprised of true soaps, alkyl aryl sulfonates, alkyl sulfates, and nonionics of the ethyl-oxylated nonyl and octyl phenols and alcohol types. In recent years considerations of biodegradability have caused changes to linear alkyl aryl sulfonates, straight chain alcohols, etc. Thus, the situation exists that very large tonnages of the above-described detergent types are being released to sewage effluents and surface waters.

Although control of water-pollution, both Federal and State, dates back many years, it was not until the Federal Water Pollution Control Act Amendments of 1961 that the significance of the program was elevated. Finally, the Federal Water Pollution Control Act Amendments of 1972 established firm guidelines as to what constituted water pollution. One requirement arising from these new regulations reads that no discharge into sanitary sewer systems of industrial waste having a 96-hour median tolerance limit (TLm) of less than 50% would be allowed. To determine the toxicity of various substances to marine and aquatic life other than microorganisms, standard methods of bioassay are used. (See, for example, *Standard Methods for the Examination of Water and Waste Water,* 13th Edition, prepared and published jointly by American Public Health Association, American Water Works Association, Water Pollution Control Federation, Publication Office; American Public Health Association, 1740 Broadway, New York, N. Y. 10019, Section 231, and *Water Quality Criteria,* Publication 3-A, California State Water Resources Control Board). The terms "TL 50" and "TLm 50", indicate the tolerance limits at existing or stated concentration of indicated pollutants. Fish survival tests indicate percent of fish surviving in a given solution or effluent in a given period of time. In all cases, our tests were run for a 96-hour period. For our purpose, the terms TL, TLm, and percent survival, are used interchangeable and when 50 or greater, indicate substantial or acceptable nontoxicity to marine or aquatic life other than microorganisms, in accordance with the standard assays. In this specification and claims it will be understood that marine or aquatic life is intended to mean "other than microorganisms." It is known that none of the detergent compositions utilizing the known true soaps, anionic, nonionic or cationic types would pass this Fish Bio-Assay Test at usual use concentrations.

As stated above the prior art teaches widespread detergent applications utilizing true soaps and synthetic surfactants of anionic, nonionic and cationic types. Again, for the purpose of brevity, these will be referred to as SANC, such an abbreviation indicating compositions of the aforementioned types, alone, mixed, or admixed with builders and suitable adjuncts.

In considering water-pollution aspects it is pointed out that not only the TLm but other restrictions are also placed on the composition of sewage effluents. In part, these would include limits in content of grease, suspended matter, chemical oxygen demand, pH range, temperature, metal content, sulfides, cyanides, phenols, chlorinated hydrocarbons, etc. Thus, it is the intent by statute to limit by prescribed maximum figure, or by a range, the inclusion of these varied substances and conditions in industrial wastes. Where violation occurs it is the responsibility of the polluter to take measures to bring the effluent within the statute requirements. It is further pointed out that many, but not all of the SANC type detergents would not contribute to violations of the latter described type, and that their known efficacy as detergents could still be utilized. However, even if none of these latter violations existed in effluents containing SANC type materials, the effluent would still be in violation because the presence of SANC types would be toxic as determined by the TLm. The removal of SANC types to safe tolerance limits (generally reported as 5–25 parts per million) from the effluent would be a costly process, and becomes unnecessary through the use of the improved detergent compositions of this invention which provides the basis for adequate detergency while still passing the TLm.

Pursuant to this invention the inventors have found that the novel detergent compositions containing the amphoteric surfactants described provide at least equivalent detersive effects as the SANC types, and that these novel compositions provide improvement in overall detersive effects to be described in greater detail later, and that, principally, these novel detergent compositions, after providing these improved detersive effects will not make the dumped waters (sewage effluent) toxic as determined by the TLm.

SUMMARY OF THE INVENTION

The invention concerns a detergent composition which is water-miscible or water-soluble and which provides very satisfactory detersive action, while at the same time producing a waste liquid or effluent which is satisfactorily nontoxic to marine or aquatic life other than microorganisms.

This invention is based in part on the discovery that amido betaines are represented in Formula I, below, are substantially nontoxic to marine or aquatic life:

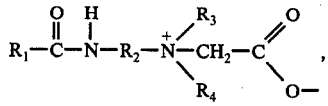

Formula I in which $R_1$ is an alkyl radical having from 12 to 18 carbon atoms, $R_2$ is an alkyl radical having from 2 to 4 carbon atoms or is a cycloalkyl ammonium radical, and $R_3$ and $R_4$ are each a radical selected from the group consisting of methyl ($-CH_3$), alkali metal substituted glycidyl, e.g., ($-CH_2CO_2Na$) and hydroxyethyl ($-C_2H_4OH$) radicals. Preferably $R_1$ is a lauryl, myristyl or oleyl radical.

Illustrative of compounds of Formula I are cocoamido-carboxymethyl betaine, oleylamidocarboxymethyl betaine laurylamido betaine, myristylamidocarboxymethyl betaine, oleylamidocarboxymethyl betaine, cocoamidoglycine betaine, cocoamidoethyl hydroxyethyl carboxymethyl glycine betaine and the like. The term "coco" expresses the fatty acids obtained from coconut oil.

In this specification and claims it will be understood that the term "amido betaine" refers to such betaines of Formula I type, except as may be otherwise stated.

When the amido group

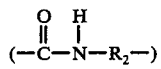

is not present, as in Formula II below, the betaine is toxic to marine or aquatic life:

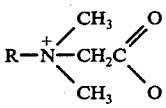

Formula II where R is an alkyl group containing 12 to 18 carbon atoms, as is cococarboxymethyl betaine, stearyl carboxymethyl betaine, and the like.

When the amido group is present but the carboxymethyl group is replaced by a sulpho group, such as in Formula III below, the betaine is similarly toxic:

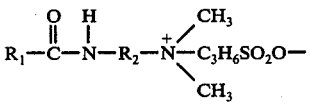

Formula III where $R_1$ is an alkyl group containing from 12 to 18 carbon atoms and $R_2$ and $C_3H_6$. These compounds are the acylsulfobetaines.

Thus, in the betaines of this invention, the amido group and the carboxymethyl group ($CH_2CO_2$) must both be present as shown in Formula I, to provide a nontoxic product as desired and as will further be shown below.

The amido betaine of this invention can be formulated into a variety of heavy-duty detergent compositions, depending on the intended use. The detergent composition consists essentially of at least one amido betaine as defined above, a detergency builder of the group set out below, advantageously a chelating or sequestering agent as defined below and, if desired, an optical brightener. The composition can be in aqueous solution, or it can be used in dry form when suitably absorbed on a dry powder such as sodium chloride, sodium sulfate, or the like. When in aqueous solution, the amido betaine can be present in an amount of from 1.5 to 30%, preferably from 2.0 to 25.0%, by weight. When in dry form there is present that amount which can be absorbed on the absorbent base powder and generally 1.5 to 15% by weight, can be used. In the composition of this invention there can advantageously be from about 10 to 25% by weight of the amido betaine, from about 20 to 60% by weight of detergency builder, and from about 20 to about 55% by weight chelating agent, and, if desired, an optical brightener, which can be present in a small amount, such as of from 0 to 2%.

At least one detergent builder can be incorporated, selected from the group, sodium hydroxide, sodium carbonate, sodium bicarbonate, sodium potassium carbonate and trisodium phosphate. Where a high alkalinity is desired, sodium hydroxide or trisodium phosphate would be preferred. Where less alkalinity and high solubility are desired, sodium potassium carbonate is preferred. Where low alkalinity is desired, sodium bicarbonate is preferred. Intermediate alkalinities can be obtained by admixtures of the above. Whatever selection is made for end use purposes, the requirement of nontoxicity must also prevail.

It is advantageous in some compositions to incorporate chelating or sequestering agents in the detergent composition. These are, for instance, sodium tripolyphosphate, tetrasodium pyrophosphate, sodium salt of ethylene diamine tetraacetic acid or sodium salt of nitrilo-acetic acid. When a dry product is desired, it is particularly advantageous to use sodium tripolyphosphate or tetrasodium pyrophosphate, or where phosphates are undesirable, to use the powdered form of the sodium salt of ethylene diamine tetraacetic acid. Again, the selection of chelating agent is made not only for its end use, but its presence admixed with the amido betaines of this invention must not be toxic to aquatic or marine life. Thus, the chelating agent can be employed in amounts varying from 20–55%.

In the composition of this invention, either the builder or the chelating agent can be omitted, but the composition will contain at least 20% of one of these components.

Optical brightness, as discussed above, may be incorporated, generally in the range of 0–2%, when an end use may be laundering, rug and upholstery washing, etc. Such optical brightener is water-soluble and can be of known type, e.g., one based on cyanuric chloride/-diaminostilbene disulfonate, such as Tinopal RBS-200 (trademark of Ciba-Geigy Corp.) which is a typically satisfactory material.

In preparation for use, the remainder of the composition is a filler, which in the case of a solution is water, and is preferably in the amount of 75 to 85%. In the caseof a dry formulation the filler is essentially of, for instance, sodium sulfate ($Na_2SO_4$) or sodium chloride (NaCl) and can generally be present in the amount of up to 85%.

In any case, the selection of any of the foregoing is restricted by the nontoxic requirements, and the molar ratio of sodium to potassium must be at least 1:1, and preferably 1:0, based on all materials present in the composition.

The detergent composition is present in the washing water in an effective concentration to remove stains and soil and to provide the desired nontoxic effluent, and the amount can be varied as desired, depending upon the materials and the condition of the materials being treated. It has also been found that by using the detergent composition of this invention comprising a sodium compound as builder and a sodium compound chelating agent, where the latter is incorporated, the toxic effect on aquatic life is avoided, and where the soils removed in the washing have a significant sodium content the detoxifying effect on the potassium is enhanced. In carrying out the process of this invention, the betaine can be suitably present in the washing-water liquid in a concentration of from 2.5 mg to 600 mg per liter, the builder in an amount of from 7 mg to 1500 mg per liter, and the chelating agent is suitably present therein in an amount of from 3.0 to 625 mg per liter, the washing liquid containing the amido betaine and at least one of the builder and the chelating agents. The typical finished detergent composition can be incorporated in a concentration in the washing water of from 100 to 12,500 mg per liter to achieve the aforementioned use dilution, and can be added dry or as a premixed aqueous solution. However, these concentrations can be varied depending upon the materials being treated, the soil to be removed, etc.

OBJECTS OF THE INVENTION

Applicants have found that detergent compositions as described herein provide improved detersive action in a multitude of cleaning operations and still provide aqueous solutions that are nontoxic to marine or aquatic life. From the foregoing, it is seen that the invention has as a principal object the provision of an efficacious detergent composition for variable applications while at the same time providing use solutions or effluents that satisfy the toxicity limits as prescribed by the existing statutes and thus allow the users to discharge wastes to sewer systems and surface waters without being held in violation of the aforesaid provisions of these statutes.

Another object of this invention is to provide detergent compositions which will have a detoxifying effect on otherwise toxic soils and other substances.

Another object of this invention is to provide a detergent composition which will adequately launder textiles and still maintain whiteness retention (prevent "graying") after repeated washings, particularly as it concerns polyester fiber and cotton blends which have currently come into widespread use.

Other objects of this invention will become readily apparent from the detailed description to follow.

DETAILED DESCRIPTION OF THE INVENTION

The invention will be illustrated by the following specific examples which are to be considered as illustrative only. The examples, for instance, show fabric detergency but are also useful for hard surface cleaning. In each of the following examples, cleaning results are very satisfactory and the washing effluent satisfies the TLm requirements, being sufficiently nontoxic to marine or aquatic life.

Example 1

The following formulation is made up for laundry application:

| | W | D |
|---|---|---|
| | Water Solution | Active Ingredients Basis |
| Coco amido carboxymethyl betaine (60% active) (at 100% active) | 4.8% (2.88%) | 21.5% |
| Tinopal (RBS-200) (brightener) | 0.2% | 0.9% |
| Ethylenediamine tetraacetic acid tetrasodium salt (EDTA) | 5.0% | 23.0% |
| Sodium hydroxide | 12.0% | 54.6% |
| Water | 78.0% | |

When 16 oz. by weight of the concentrate W is added to 400 pounds of water, the concentration in the washing medium is 2500 mg per liter of the dry basis formulation; 120 mg per liter of coco fatty amido betaine; 125 mg per liter of EDTA; and 300 mg per liter of NaOH. If desired, in an alternative formulation 5A, the water can be substituted by 78% $Na_2SO_4$, which provides a composition readily soluble in the washing water. Calculated quantities in the sewage effluent: coco fatty amido betaine, 24 mg/liter; EDTA, 25 mg/liter; and NaOH, 30 mg/liter. This formula was tested in a commercial laundry with the following results:

(a) Less washovers (better detergency) than with SANC type formula previously used.
(b) Greater whiteness retention observed after multiple washings over 6 months.
(c) The one formulation (product) replaced four different SANC type products previously used, that were required to obtain satisfactory results as in (a) and (b).
(d) Reduced static. All garments in this plant are 65% polyester and 35% cotton, thus subject to static. This was previously controlled with use of a cationic fabric softener. The use of this was eliminated by the invention and is not one of the four mentioned in (c).
(e) Perceptible and adequate softening effect without added cationic fabric softener.
(f) Reduced drying time.
(g) Simplified wash formula.
(h) Greater production through lower washovers, reduced drying time, faster finishing, etc.
(i) TLm Results: with SANC materials lows of 15% to a high of 45% were obtained. The latter result was obtained only after silico fluoride sour and the cationic fabric softener, both known to be toxic, were removed from the formula. However, even then the SANC types were toxic. Results with the invention were TLm = 100% on four different samples and 100% survival of fish in the undiluted effluent after 96 hours.

Example 2

In another test, the solution formulation (W) of Example I was employed to wash 100 pounds of white shop towels using 80 ounces of the solution and washing at 150° F. instead of the usual 210° F. Nine rinses were carried out at 150° F. instead of the conventional five at 210° F. and four at 170° F. This resulted in an overall saving in heat of 252,000 B.T.U.'s. Concentration of coco amido betaine in detergent bath, 600 mg/liter; of EDTA, 625 mg/liter; of NaOH, 1500 mg/liter. Calculated concentration of coco amido betaine in washing effluent, 41 mg/liter; of EDTA, 43 mg/liter; of NaOH, 52 mg/liter. Detergency results were: Sink test time as obtained with SANC type materials, 45 seconds; with composition of invention, 22 seconds. The sink test is used on shop towels as a quick estimate of the absorbency of the towel. In this test, the towel is folded twice, dropped flat on the surface of water in a suitable vessel, and there is determined the time in seconds required for it to wet and submerge. The more oil left in it from the wash, the longer it takes to submerge.

Example 3

One 100-pound load of white cotton coveralls and one 100-pound load of blue 50% polyester 50% cotton coveralls were also washed with the composition as in Example 1 and with similar results.

Fish Bio-Assay or TLm Results

A composite sample of the washing effluents from Examples 1 and 2 showed a TLm of 90%. In another laundry with SANC type materials the TLm was 1.5% when shop towels were washed. A composite sample of washing effluent from Example 2 showed a TLm of 100% with 100% fish survival of the undiluted effluent after 96 hours.

Example 4

The composition according to the invention is here used in rug washing. The formulation is as follows:

| | 3 Water Solution | 4 Active Ingredients Basis |
|---|---|---|
| Coco amido carboxymethyl betaine (active basis) | 4.8% | 4.8% |
| Tinopal RBS-200 | 0.2% | 0.2% |
| EDTA | 5.0% | — |
| STPP | — | 25.0% |
| $KNaCO_3$ | 15.0% | — |
| $Na_2CO_3$ | — | 15.0% |
| Water | 75.0% | — |
| NaCl | — | 55.0% |

The use of concentration of the solution, formulation 3, is 2 to 6 ounces in a wash load, equivalent to 1500–9000 milligram per liter of the composition, formulation 3. In an alternative formulation, 3A, the water can be substituted by 75% sodium sesquicarbonate.

The above was tested at a commercial rug-washing establishment with the following results: Detergency was good, static on nylon rugs was greatly reduced, and a composite sample of the washing effluents showed a TLm of 82%. The latter result is believed due to the presence of a significant residue of SANC type, previously used detergents on the rugs which provided an increased sodium content in the washing effluent. The concentration of the "active ingredients basis" composition (4) of the invention, in the washing effluent, was 500 mg/liter, the starting concentration in the wash medium having been 2000 mg/liter. The effluent also contained approximately 300 mg/liter of SANC-type substances, calculated as sodium lauryl sulfate, that had remained as a residue on the rugs from previous shampooing. At another rug-washing shop, where SANC-type detergents were used, and no composition according to this invention was added, a composite sample of the washing effluent exhibited a TLm of 25%.

Example 5

Similar nontoxic results were obtained in household laundry applications in which the wash water use dilutions provided very adequate detersive results, reduced static effects, perceptible and adequate softening of fabrics in the following two series of tests:

Series I—The concentrations were varied between 12–50 mgm/liter of coco amido carboxymethyl betaine, 22–100 mgm/liter of sodium carbonate, 7–35 mgm/liter of EDTA.

Series II–The concentrations were varied between 12–50 mgm/liter of coco amido carboxymethyl betaine, 20–100 mgm/liter of sodium potassium carbonate, and 25–130 mgm/liter of sodium tripolyphosphate.

In carrying out the process of this invention according to the above two series, any or all of the amount of components can be varied as indicated.

The use dilutions as expressed in both Series I and II also provided excellent detergency for the cleaning of wood, title and linoleum floors, for the cleaning of painted and tile walls and for porcelain finished appliances and bathroom fixtures. Higher concentrations (500–8000 mgm/liter) were efficient in cleaning greasy soils such as on kitchen walls and stove surfaces without affecting painted surfaces.

Compositions to provide the above use dilution concentrations, according to the invention, could be packaged for use in dry or aqueous solution form.

TABLE I

| Formula Number | Identification | Test Compositions: Ingredients in Percent by Weight — Type | Modified Betaine | EDTA | NaOH | RBS-200 | $H_2O$ |
|---|---|---|---|---|---|---|---|
| B | Velvetex BA[1] | Coco fatty amido betaine | 2.88 | 5.0 | 12.0 | 0.2 | q.s. |
| B-1 | Tegobetaine C[2] | Coco fatty amido betaine | 4.65 | 3.8 | 10.0 | 0 | q.s. |
| C | Velvetex HW[1] | Cocoyl amidocycloalkyl ammonium carboxymethyl betaine | 4.65 | 3.8 | 10.0 | 0 | q.s. |
| D | Velvetex CGW[1] | Coco fatty amido glycine betaine | 4.65 | 3.8 | 10.0 | 0 | q.s. |
| F | Velvetex BCW[1] | Coco fatty betaine | 4.65 | 3.8 | 10.0 | 0 | q.s. |
| G | Velvetex BST[1] | Alkyl ($C_{16}$–$C_{18}$) betaine | 4.65 | 3.8 | 10.0 | 0 | q.s. |
| H | Sulfabetaine CA[1] | Acylamido ammonium sulfonic acid betaine | 4.65 | 3.8 | 10.0 | 0 | q.s. |

[1]=Trademark of Textilana Corporation
[2]=Trademark of Goldschmidt Chemical - Division of Wilson Pharmaceutical and Chemical Corp.
q.s.=balance is water to 100%

The above formulations were used in a household detersive operation in a concentration of 100 mg/liter of the formulation. The concentration of active ingredients or components in the washing solution, therefore, are shown in Table II below.

TABLE II

| Formula Number | Test concentrations: mg/liter active Ingredients — Amphoteric % Active | EDTA | NaOH | RBS-200 |
|---|---|---|---|---|
| B | 2.88 | 5.0 | 12.0 | 0.2 |
| B-1 | 4.65 | 3.8 | 10.0 | 0 |
| C | 4.65 | 3.8 | 10.0 | 0 |
| D | 4.65 | 3.8 | 10.0 | 0 |
| F | 4.65 | 3.8 | 10.0 | 0 |
| G | 4.65 | 3.8 | 10.0 | 0 |

TABLE II-continued

| Formula Number | Test concentrations: mg/liter active Ingredients Amphoteric % Active | EDTA | NaOH | RBS-200 |
|---|---|---|---|---|
| H | 4.65 | 3.8 | 10.0 | 0 |

The solutions were each subjected to the standard Fish Bio-Assay Test and the results are shown in Table III below.

TABLE III

| Formula Number | | |
|---|---|---|
| B, B-1, C,D, | 100% survival of fish | TLm >100% |
| F,G,H, | 0% survival of fish | TLm no pass |

In other tests on compositions according to this invention containing coco amido carboxymethyl betaine and EDTA, where $KNaCO_3$ was added in one test and $Na_2CO_3$ in the other, TLm values obtained were, respectively, 80–85% and >100%.

Example 6

Another suitable and successful formula is as follows:

| | | |
|---|---|---|
| Water | 49.1% | by weight |
| Tetrasodium EDTA, 40% liquid | 13.16% | by weight |
| Sodium bicarbonate ($NaHCO_3$) | 9.10% | by weight |
| Potassium hydroxide (KOH) | 10.56% | by weight |
| SV-concentrate (product of GAF), a brightener | 0.10% | by weight |
| Sulfontex SX5-40 (product of Textilina-Henkel Corporation) | 5.11% | by weight |
| Velvetex-HW (product of Textilana-Henkel Corporation) | 12.06% | by weight |

The pH of the finished formula is 10.5; its specific gravity is 1.165; it weighs 9.7 pounds per gallon.

It will be understood that the above specific description and examples are given for purposes of illustration only and that variations can be made therein by those skilled in the art, without departing from the spirit and scope of the appended claims. Percentages or parts given herein are by weight unless otherwise indicated. In this specification and claims the terms "coco amido carboxymethyl betaine", "coconut oil fatty acid amido betaine", "coco amido betaine" and "coco fatty amido betaine" are used interchangeably, where they may occur. The definition of median tolerance limit, TLm, and description of Fish Bio-Assays are given in "Standard Methods for the Examination of Waste and Wastewater", 13th Edition, published jointly by American Public Health Association, American Water Works Association and Water Pollution Control Federation, pp. 562–575.

We claim:

1. A heavy-duty detergent for cleaning fabrics while providing a wash-water effluent which is nontoxic to aquatic or marine life other than microorganisms, consisting essentially of:

(a) from 10 to 25% by weight of at least one amido betaine of the formula

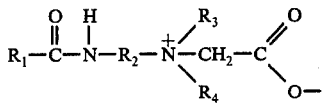

in which $R_1$ is an alkyl radical containing from 12 to 16 carbon atoms, $R_2$ is selected from the group consisting of a cycloalkyl ammonium radical and an alkyl radical containing from 2 to 4 carbon atoms, and $R_3$ and $R_4$ are each a radical selected from the group consisting of methyl, hydroxyethyl and alkali metal substituted glycidyl radicals, (b) from 20 to 60% by weight of a detergency builder selected from the group consisting of sodium hydroxide, sodium carbonate, sodium bicarbonate, sodium potassium carbonate and trisodium phosphate, (c) from 20 to 55% by weight of a chelating or sequestering agent selected from the group consisting of sodium tripolyphosphate, tetrasodium pyrophosphate, sodium salt of ethylene diamine tetraacetic acid, and the sodium salt of nitrilo-triacetic acid, and (d) from 0 to 2% of an optical brightener, the sodium to potassium ratio in said detergent being in the range of from 1:1 to 1:0.

2. Composition as in claim 1 wherein said amido betaine is coconut oil fatty acid amido betaine.

3. Composition as in claim 1 wherein said amido betaine is coconut oil fatty acid amido glycine betaine.

4. A heavy-duty detergent for cleaning fabrics while providing a wash-water effluent which is nontoxic to aquatic or marine life other than microorganisms, consisting essentially of:

(a) from 10 to 25% by weight of at least one amido betaine of the formula

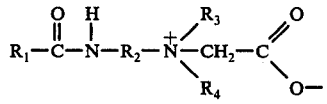

in which $R_1$ is an alkyl radical containing from 12 to 18 carbon atoms, $R_2$ is selected from the group consisting of a cycloalkyl ammonium radical and an alkyl radical containing from 2 to 4 carbon atoms, and $R_3$ and $R_4$ are each a radical selected from the group consisting of methyl, hydroxyethyl and alkali metal substituted glycidyl radicals, (b) from 20 to 60% by weight of sodium hydroxide as detergency builder, (c) from 20 to 55% by weight of a chelating or sequestering agent selected from the group consisting of sodium tripolyphosphate, tetrasodium pyrophosphate, sodium salt of ethylene diamine tetraacetic acid, and the sodium salt of nitrilo-triacetic acid, and (d) from 0 to 2% of an optical brightener, the sodium to potassium ratio in said detergent being in the range of from 1:1 to 1:0.

5. Composition as in claim 1 wherein said builder is sodium carbonate.

6. Composition as in claim 1 wherein said builder is sodium potassium carbonate.

7. A heavy-duty detergent composition adapted to provide a washing effluent having a sodium to potassium molar ratio of at least 1:1, consisting essentially of from about 10 to 25% by weight of at least one amido betaine selected from the group consisting of coconut oil fatty acid amido betaine, coconut oil fatty acid amido glycine betaine, laurylamido betaine, myristylamido betaine and cocoyl amido cycloalkylammonium carboxymethyl betaine from about 20 to 60% by weight of a detergent builder selected from the group consisting of sodium hydroxide, sodium carbonate, sodium bicarbonate, sodium potassium carbonate and trisodium phosphate, and from about 20 to 55% by weight of a chelating agent selected from the group consisting of sodium tripolyphosphate, tetrasodium pyrophosphate, sodium salt of ethylene diamine tetraacetic acid, and the sodium salt of nitrilo-triacetic acid.

8. Composition as in claim 7 wherein said chelating agent is the sodium salt of ethylene diamine tetraacetic acid.

9. Composition as in claim 7 wherein said chelating agent is sodium tripolyphosphate.

10. The composition of claim 7 containing also a small amount of an optical brightener.

11. The composition of claim 7 containing from 0 to about 2.0% of an optical brightener.

12. A heavy-duty detergent composition adapted to provide a washing effluent having a molar ratio of sodium to potassium of at least 1:1, consisting essentially of 2.88% coco fatty amido betaine, 5.0% sodium salt of ethylene diamine tetraacetic acid, 12.0% sodium hydroxide, 0.2% optical brightener and the remainder water to 100% total.

13. A heavy-duty detergent composition adapted to provide a washing effluent having a sodium to potassium molar ratio of at least 1:1, consisting essentially of 8% coco fatty amido betaine, 5.0% sodium salt of ethylene diamine tetraacetic acid, 15% sodium potassium carbonate and 0.2% optical brightener, and water to 100%.

14. A heavy-duty laundry detergent providing a wash-water effluent having a sodium-to-potassium mol ratio of at least 1:1 and which is nontoxic to aquatic or marine life, consisting essentially of 21.5% by weight of 60% active cocoamido carboxymethyl betaine, 23% by weight of tetrasodium salt of ethylene diamine tetraacetic acid, 54.6% by weight of sodium hydroxide, and 0.9% by weight optical brightener.

15. A heavy-duty detergent especially adapted to rug washing, and providing a wash-water effluent having a sodium-to-potassium mol ratio of at least 1:1 and which is tolerated by aquatic or marine life, consisting essentially of 4.8% by weight cocoamido carboxymethyl betaine, 5.0% by weight of the sodium salt of ethylene diamine tetraacetic acid, 15.0% by weight potassium sodium carbonate, 0.2% optical brightener and 75.0% water.

16. A heavy-duty detergent adapted to rug washing, having very good cleansing power and providing a wash-water effluent having a sodium-to-potassium mol ratio of at least 1:1 and which is nontoxic to aquatic or marine life, consisting essentially of 4.8% by weight cocoamido carboxymethyl betaine, 15.0% by weight sodium carbonate, 25.0% by weight sodium tripolyphosphate, and 0.2% by weight optical brightener and 55.0% by weight sodium chloride.

17. A heavy-duty detergent which is nontoxic to aquatic or marine life and is adapted to support 100% fish survival in a standard Fish Bio-Assay Test, consisting essentially of 4.65% by weight of an amido betaine selected from the group consisting of coco fatty amido betaine and coco fatty amido glycine betaine, 3.8% by weight sodium salt of ethylene diamine tetraacetic acid, 10.0% sodium hydroxide, and balance water to 100%.

18. Method for washing objects and providing a washing effluent which is nontoxic to aquatic or marine life, which comprises water-washing a soiled or stained material with a water solution of a heavy-duty detergent composition consisting essentially of (a) from about 10 to 25% by weight of at least one amido betaine of the formula:

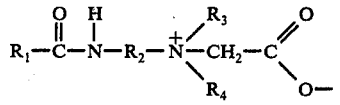

in which $R_1$ is an alkyl radical containing from 12 to 18 carbon atoms, $R_2$ is selected from the group consisting of a cycloalkyl ammonium radical and an alkyl radical containing from 2 to 4 carbon atoms, and $R_3$ and $R_4$ are each a radical selected from the group consisting of methyl, hydroxyethyl and alkali metal substituted glycidyl radicals, (b) from about 20 to 60% by weight of a detergency builder selected from the group consisting of sodium hydroxide, sodium carbonate, sodium bicarbonate, sodium potassium carbonate and trisodium phosphate, and (c) from about 20 to 55% by weight of a chelating or sequestering agent selected from the group consisting of sodium tripolyphosphate, tetrasodium pyrophosphate, sodium salt of ethylene diamine tetraacetic acid, and the sodium salt of nitrilo-triacetic acid, and (d) from 0 to 2% optical brightener, said weight percents being based on the total dry weight of said detergent composition; and separating of said washing effluent, the sodium to potassium ratio in said detergent composition being in the range of from 1:1 to 1:0.

19. Method as in claim 18 wherein said amido betaine is coconut oil fatty amido betaine.

20. Method for washing objects and providing a washing effluent which is nontoxic to aquatic or marine life, which comprises water-washing a soiled or stained material with a water solution of a heavy-duty detergent composition consisting essentially of (a) from about 10 to 25% by weight of at least one amido betaine of the formula:

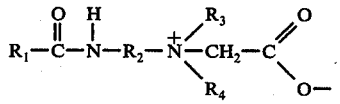

in which $R_1$ is an alkyl radical containing from 12 to 18 carbon atoms, $R_2$ is selected from the group consisting of a cycloalkyl ammonium radical and an alkyl radical containing from 2 to 4 carbon atoms, and $R_3$ and $R_4$ are each a radical selected from the group consisting of methyl, hydroxyethyl and alkali metal substituted glycidyl radicals, (b) from about 20 to 60% by weight of sodium hydroxide as detergency builder, (c) from about 20 to 55% by weight of a chelating or sequestering agent selected from the group consisting of sodium tripolyphosphate, tetrasodium pyrophosphate, sodium salt of ethylene diamine tetraacetic acid, and the sodium salt of nitrilo-triacetic acid, and (d) from 0 to 2% optical brightener, said weight percents being based on the total dry weight of said detergent composition; and separating off said washing effluent, the sodium to potassium ratio in said detergent composition being in the range of from 1:1 to 1:0.

21. Method as in claim 18 wherein said builder is sodium carbonate.

22. Method as in claim 18 wherein said builder is sodium potassium carbonate.

23. Method as in claim 18 wherein said sequestering agent is the sodium salt of ethylene diamine tetraacetic acid.

24. Method as in claim 18 wherein said sequestering agent is sodium tripolyphosphate.

25. A heavy-duty detergent composition adapted to provide a washing effluent having a molar ratio of sodium to potassium of at least 1:1, consisting essentially of an admixture of (a) at least one amido betaine of the formula

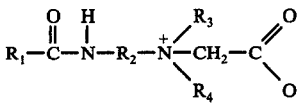

in which $R_1$ is an alkyl radical containing from 12 to 16 carbon atoms, $R_2$ is selected from the group consisting of a cycloalkyl ammonium radical and an alkyl radical containing from 2 to 4 carbon atoms, and $R_3$ and $R_4$ are each a radical selected from the group consisting of methyl, hydroxyethyl and alkali metal substituted glycidyl radicals, (b) a detergency builder selected from the group consisting of sodium hydroxide, sodium carbonate, sodium bicarbonate, sodium potassium carbonate and trisodium phosphate, (c) a chelating or sequestering agent selected from the group consisting of sodium tripolyphosphate, tetrasodium pyrophosphate, sodium salt of ethylene diamine tetraacetic acid, and the sodium salt of nitrilo-triacetic acid, and (d) from 0 to 2% by weight of an optical brightener, (e) such (a), (b), and (c) components being present in amounts to provide in a washing water liquid from 2.5 to 600 mg per liter (a), from 20 to 1500 mg per liter (b), and from 3 to 625 mg per liter (c), (f) said detergent composition being incorporated in a concentration in the washing water of from 100 to 12,500 mg per liter.

26. Composition as in claim 25 wherein said betaine is cocofattyamido betaine.

27. Composition as in claim 25 wherein said betaine is cocoamido carboxymethyl betaine.

28. Composition as in claim 25 wherein said builder is sodium hydroxide.

29. Composition as in claim 25 wherein said builder is sodium potassium carbonate.

30. Composition as in claim 25 wherein said builder is sodium carbonate.

31. Composition as in claim 25 wherein said chelating agent is the sodium salt of ethylene diamine tetraacetic acid.

32. Composition as in claim 25 wherein said chelating agent is sodium tripolyphosphate.

33. A heavy-duty detergent composition which provides a washing effluent having a sodium-to-potassium molar ratio of at least 1:1, consisting essentially of at least one modified betaine from the group consisting of coconut oil fatty acid amido betaine, coconut oil fatty acid amido glycine betaine, laurylamido betaine, myristylamido betaine and cocoyl amido cycloalkylammonium carboxymethyl betaine, a detergent builder chosen from the group consisting of sodium hydroxide, sodium carbonate, sodium bicarbonate, sodium potassium carbonate and trisodium phosphate, and a sodium compound chelating agent, said composition providing a wash effluent which is nontoxic to aquatic or marine life other than microorganisms and having heavy-duty detersive action to remove stains and soils from materials being washed when present in washing water in an effective concentration.

34. A heavy-duty detergent composition as in claim 33 wherein said composition is present in the washing in a concentration of from 100 to 12,500 mg per liter.

35. A heavy-duty detergent composition as in claim 34 wherein said modified betaine is present in a concentration of from 2.5 to 600 mg per liter.

36. A heavy-duty detergent composition as in claim 34 wherein said builder is present in an amount of from 20 to 1500 mg per liter.

37. A heavy-duty detergent composition as in claim 34 wherein said chelating agent is present in an amount of from 3.0 to 625 mg per liter.

* * * * *

UNITED STATES PATENT AND TRADEMARK OFFICE

CERTIFICATE OF CORRECTION

PATENT NO. : 4,122,043

DATED : October 24, 1978

INVENTOR(S) : Paul Kersnar and Robert Joseph O'Connor

It is certified that error appears in the above-identified patent and that said Letters Patent are hereby corrected as shown below:

Column 1, line 65, "interchangeable" should read --interchangeably--.

Column 8, line 30, "title" should read --tile--.

Column 9, Example 6, line 8 of left-hand column, "Textilina" should read --Textilana--.

Column 10, line 2, "16 carbon atoms" should read --18 carbon atoms--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*